US005279215A

United States Patent [19]

Harder

[11] Patent Number: 5,279,215

[45] Date of Patent: Jan. 18, 1994

[54] MACHINE FOR CRUSHING OIL FILTERS

[76] Inventor: Willard J. Harder, 8556 Hiawatha Ave., Eden Prairie, Minn. 55347

[21] Appl. No.: 803,115

[22] Filed: Dec. 5, 1991

[51] Int. Cl.[5] ..... B30B 15/14; B30B 9/02; B30B 1/32

[52] U.S. Cl. ..... 100/48; 100/53; 100/116; 100/125; 100/246; 100/269.00 R; 100/902

[58] Field of Search ..... 100/48, 53, 125, 131, 100/246, 252, 269R, 902, 50, 52; 91/321, 356, 417R

[56] References Cited

U.S. PATENT DOCUMENTS

| | | | |
|---|---|---|---|
| 2,253,617 | 8/1941 | Griffith | 100/52 |
| 2,691,962 | 10/1954 | Johnson | 91/356 |
| 2,715,389 | 8/1955 | Johnson | 91/356 |
| 2,737,995 | 3/1956 | Jennings . | |
| 2,949,894 | 8/1960 | Hewitt | 91/417 R |
| 3,165,979 | 1/1965 | Clerk | 91/321 |
| 3,336,861 | 8/1967 | Clar | 100/52 |
| 3,437,033 | 4/1969 | Day et al. . | |
| 3,481,268 | 8/1968 | Price et al. . | |
| 3,500,753 | 3/1970 | Greene, Jr. | 91/321 |
| 3,517,607 | 6/1970 | Keagle . | |
| 3,592,217 | 7/1971 | Keagle . | |
| 3,636,863 | 1/1972 | Woyden . | |
| 3,654,854 | 4/1972 | Cook | 100/52 |
| 3,672,402 | 6/1972 | Bloemer | 91/417 R |
| 3,673,952 | 7/1972 | Durbin, III . | |
| 3,785,278 | 1/1974 | Hopkins | 100/52 |
| 3,838,634 | 10/1974 | Alexandrov et al. . | |
| 3,869,978 | 3/1975 | Steinberg | 100/52 |
| 3,963,383 | 6/1976 | Hill . | |
| 4,005,648 | 2/1977 | Edwards | 100/229 A |
| 4,099,547 | 7/1978 | Hyden . | |
| 4,102,259 | 7/1978 | Thompson et al. . | |
| 4,162,878 | 7/1979 | Puglisi | 100/53 |
| 4,373,433 | 2/1983 | Kamei et al. . | |
| 4,459,906 | 7/1984 | Cound et al. . | |
| 4,771,686 | 9/1988 | Triantos, Jr. | 100/902 |
| 4,927,085 | 5/1990 | Oberg | 100/902 |
| 5,060,564 | 10/1991 | Buford | 100/902 |
| 5,109,763 | 5/1992 | Morris | 100/902 |
| 5,136,934 | 8/1992 | Darby, Jr. | 100/902 |
| 5,174,199 | 12/1992 | King | 100/48 |

*Primary Examiner*—Philip R. Coe
*Assistant Examiner*—Randall E. Chin
*Attorney, Agent, or Firm*—Burd, Bartz & Gutenkauf

[57] ABSTRACT

A machine for crushing oil filters and collecting the oil therefrom. The machine has a piston and cylinder assembly for moving a crushing member into a crushing chamber to crush an oil filter. A control valve controls the supply of hydraulic fluid to the piston and cylinder assembly. Air under pressure is also supplied to the piston and cylinder assembly to move the crushing member back to its initial position. A lock is mounted on the actuator of the control valve for holding a door providing access to the crushing chamber in the closed position. When the actuator is moved to a position to allow fluid to flow to the cylinder the door is locked in the closed position. A second lock structure maintains the door in the closed position during the time that the crushing member is performing the crushing operation. The crushing member must be moved to its initial position to release the second lock structure before the door can be opened.

58 Claims, 11 Drawing Sheets

MACHINE FOR CRUSHING OIL FILTERS

FIELD OF THE INVENTION

The invention relates to an article crushing apparatus and controls for operating the apparatus. The apparatus is used to crush oil filters and collect the oil from the oil filters and dispose of the crushed filters in an environmentally compatible manner.

BACKGROUND OF INVENTION

Internal combustion engines for automobiles and trucks have replaceable oil filters comprising a metal casing enclosing filter material. Periodically the oil filters are exchanged for new oil filters. The used oil filters are disposed of in land fills and incinerators. The oil filters when removed from the internal combustion engines retain a quantity of oil. This oil is disposed of along with the filters. In land fill disposal of oil filters the oil can contaminate the soil and ground water.

An oil can crusher which flatten oil cans and discharge the flattened oil cans into a barrel is disclosed by J. C. Jennings in U.S. Pat. No. 2,737,995. This crusher uses an air cylinder to move a piston toward a fixed wall to crush an oil can. The crushed oil can along with any oil therein is deposited in an oil drum. S. E. Keagel in U.S. Pat. No. 3,517,607 discloses an automatic article crusher for breaking a bottle or can with a hydraulic cylinder operable to move a platen to crush the article. A spool control valve controls the flow of hydraulic fluid to the cylinder. The control valve is equiped with a hydraulic fluid pressure responsive release valve that automatically returns the control valve to its initial position after a predetermined hydraulic fluid pressure is reached. The entire crushing apparatus is located within a housing which precludes access to the crushing apparatus. This article crushing apparatus is not suitable for crushing oil filters and does not have any provision to collect oil from the oil filters.

SUMMARY OF INVENTION

The invention relates to a machine for crushing an article, such as an oil filter, to recover oil from the oil filter and crush the metal of the oil filter so it can be recycled in an economical and environmental manner. The machine can be used to crush and flatten other articles and objects including cans, bottles, containers and boxes made of metal, wood, plastic or paper. The machine has a crushing apparatus operable to crush the article into a flat condition. A control is used to start and stop the operation of the crushing apparatus. A housing encloses the crushing apparatus having a moveable crushing member and a crushing chamber to prevent accidental and inadvertent access to the crushing chamber and movement of the article out of the crushing chamber during the crushing operation. The housing has a door that is moveable from the a closed position to an open position to permit loading and unloading of the article into the crushing chamber. A lock member operatively associated with the control holds the door in the closed position during operation of the crushing apparatus so that the door cannot be inadvertently opened during the crushing operation. A second lock mechanism is used in addition to the lock member to ensure that the door is in the closed position during the entire crushing operation. The second lock mechanism is released in response to movement of the crushing member to its initial or inoperative position to allow the door to be moved to the open position. The door can only be moved from the closed position to the open position when both the lock member and the second lock mechanism are in their release positions.

In one embodiment of the invention the crushing apparatus has a frame that provides a crushing chamber for accommodating an oil filter. The crushing apparatus includes a piston and cylinder assembly having a cylinder connected to the frame and a piston moveably located in the cylinder. A piston rod is connected to the piston and a crushing member which moves into the crushing chamber on movement of the piston in the cylinder to crush an oil filter. A pump is used to supply hydraulic fluid under pressure to a control that is fluidly connected to the cylinder. The control has a spool valve moveable to a first position to block or prevent the flow of hydraulic fluid to the cylinder and to a second position to allow fluid under pressure to flow to the cylinder thereby move the piston and crushing member into the crushing chamber to crush an oil filter. The crushing apparatus is mounted on a tank that collects the oil that drains from the crushed filter.

The control is a spool valve having an actuator moveable to a first position to block the flow of fluid to the cylinder and moveable to a second position to allow fluid to flow to the cylinder. A lock member mounted on the actuator is engageable with the door to hold the door in the closed position when the actuator is in the second position. The lock member is located out of engagement with the door when the actuator is in the first position thereby allowing the door to be moved to the open position when the crushing member is in its up or initial position. The second lock mechanism is a latch plate moveably mounted on the frame for movement between a first position to prevent the door from being moved from the closed position to the open position and for movement with crushing member to a second position to allow the door to be moved to the open position when the crushing member is above the crushing chamber in its up position.

A pump means is operated in response to air under pressure to supply hydraulic fluid under pressure to the valve which directs the fluid to the upper end of the cylinder. The air under pressure is also supplied to the lower end of the cylinder opposite the hydraulic fluid whereby the air under pressure moves the crushing member to its initial position when the supply of hydraulic fluid to the cylinder has been terminated. The hydraulic fluid in the cylinder flows back to a reservoir. The control valve is associated with a pressure responsive relief unit that will move the spool of the control valve back to its first position in response to a predetermined pressure, such as 1,500 psi, of the hydraulic fluid being supplied to the cylinder. When the control valve is in the first position the supply of fluid to the cylinder is terminated thereby terminating the crushing operation. The crushing member is returned to its initial position by the air under pressure supplied to the cylinder.

In another embodiment of the invention of the crushing apparatus for crushing oil filters, a piston and cylinder assembly is used to move an oil filter in an upward direction against a fixed block to crush the oil filter and collect the oil therefrom. The housing enclosing the piston and cylinder assembly and crushing chamber has an opening that is normally closed with a door. The door is lowered to provide access into the crushing chamber. A platform is operatively connected to the piston rod of the piston and cylinder assembly for accommodating the oil filter. The platform has an oil collection chamber that allows the oil to be drained into a container or tank. An air operated pump is used to supply hydraulic fluid under pressure to a control valve that controls the operating functions of the piston and cylinder assembly. The control valve has a spool moveable to a first position to block the flow of hydraulic fluid to the piston and cylinder assembly and a second position to allow fluid under pressure to flow to the piston and cylinder assembly thereby move the platform in an upward direction to crush an oil filter. The control valve has a moveable actuator that supports a lock member to hold the door in the closed position when the actuator is in the in or operating position. The lock member is located out of engagement with the door when the actuator is in its inoperative position and allows the door to be moved to an open position. A second lock mechanism is used to hold the door in the closed position during the crushing of the oil filter. The second lock mechanism comprises an air cylinder that is connected to the door. An air control valve for the air cylinder is operated in response to the down or lowered position of the platform to allow the door to move down to its open position. When the door is in the up or closed position and the actuator for the control valve is moved to its operative position the platform will move away from the air control valve so that the air cylinder will be subjected to air under pressure which holds the door in the closed position. The door is retained in the closed position during the entire crushing operation of the oil filter and return of the platform to its down positon. The door will remain in the closed position until the platform has been returned to its initial position at the bottom of the crushing chamber. The door will then actuate the air control valve to release air in the air cylinder to allow the door to move down to the open position.

DESCRIPTION OF PREFERRED EMBODIMENT

Figure 1:
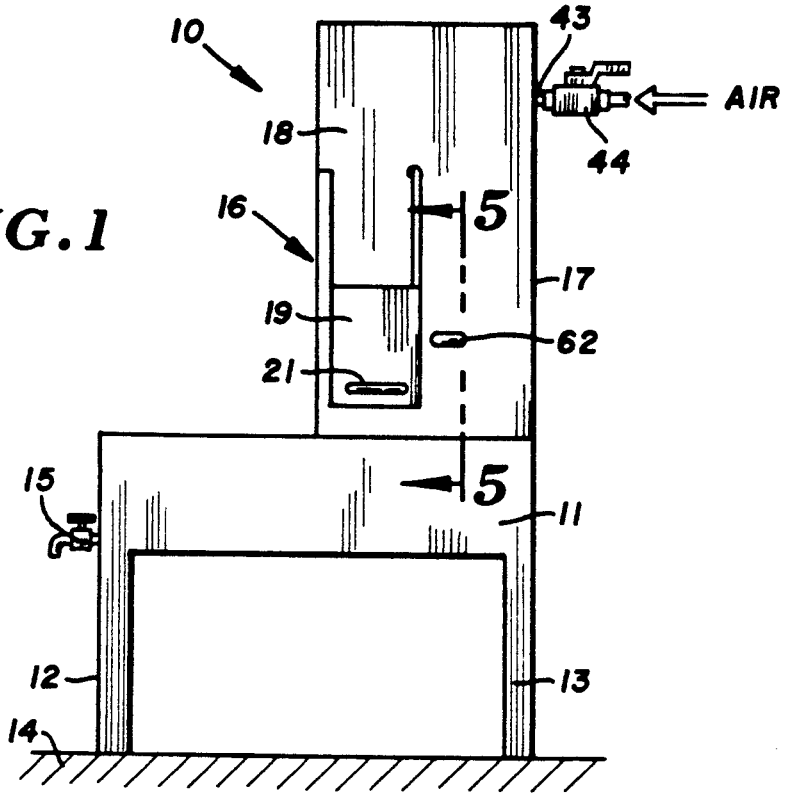
FIG. 1 is a front elevational view of the machine for crushing oil filters of the invention.

Referring to FIG. 1, there is shown a machine indicated generally at 10 for crushing objects and articles, such as oil filters, for the purpose of collecting the oil from the oil filters so that the oil can be recycled and reducing the volume of the metal casings of the oil filters so that they can be disposed of in an appropriate metal recycling program. The oil filters described herein are conventional oil filters for internal combustion engines having metal casings enclosing filter material for removing particulates and foreign materials from oil used to lubricate the engine. Machine 10 can be used to crush other articles, such as cans, bottles, containers and boxes made of metal, plastic, wood or paper. Machine 10 is described hereafter as used to crush oil filters used on internal combustion engines.

Machine 10 has an elongated horizontal tank 11 for collecting the oil from the oil filters. Tank 11 is a rectangular box structure supported on a floor or surface 14 with a plurality of upright legs 12 and 13. Tank 11 has a discharge valve 15 which is used to drain the oil from the tank for an appropriate disposal, such as an oil recycling program.

Figure 2:
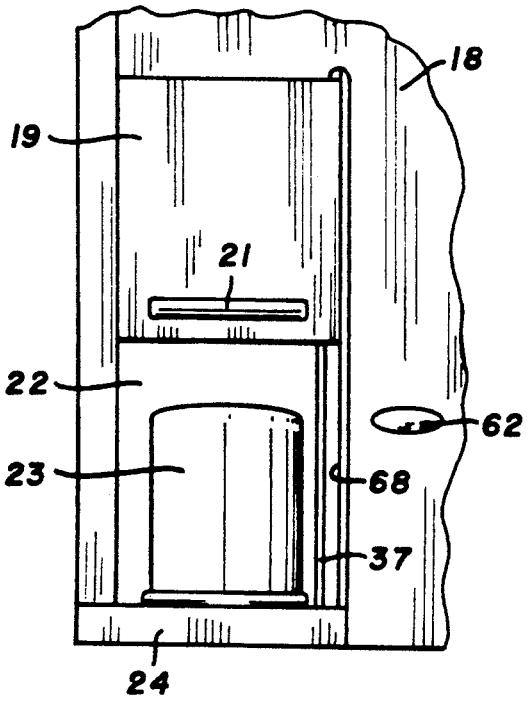
FIG. 2 is an enlarged front elevational view showing a large oil filter located in the crushing chamber of the machine of FIG. 1.

A crushing apparatus indicated generally at 16 is supported on the top of tank 11. Crushing apparatus 16 is used to longitudinally crush or reduce the volume of oil filters and squeeze the oil from the filters. The oil drains from oil filter through crushing apparatus 16 into tank 11. Crushing apparatus 16 has a box shaped housing 17 having a front upright wall 18. A vertically movable door 19 having a handle 21 is mounted on front wall 18 to provide access to a crushing chamber 22. As shown in FIGS. 2, an oil filter 23, such as a conventional oil filter having a metal casing surrounding filtering material used on an internal combustion engine, is located in crushing chamber 22. Filter 23 is supported on a base or floor 24 having a plurality of holes 26 open to tank 11, as seen in FIG. 4.

Figure 3:
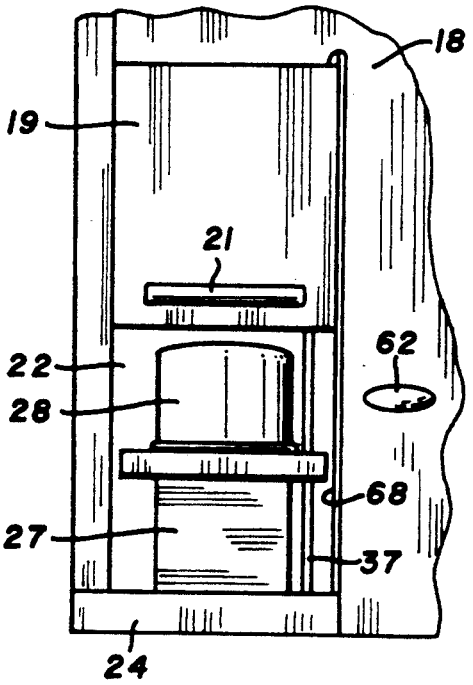
FIG. 3 is a front elevational view similar to FIG. 2 showing a small oil filter in the crushing chamber.

Referring to FIG. 3, there is shown a platform 27 located in crushing chamber 22 supporting a small or short oil filter 28 that is used with some internal combustion engines. Door 19, as shown in FIGS. 2 and 3, is in the up or open position providing front access to crushing chamber 22. When door 19 is open crushing apparatus 16 is inoperative to preclude injury to the operator of the machine. When door 19 is down or closed, it is locked in the closed position during the time crushing apparatus 16 is operating to prevent the oil filter from being forced out of crushing chamber 22 or the operator from entering crushing chamber 22.

Figure 4:
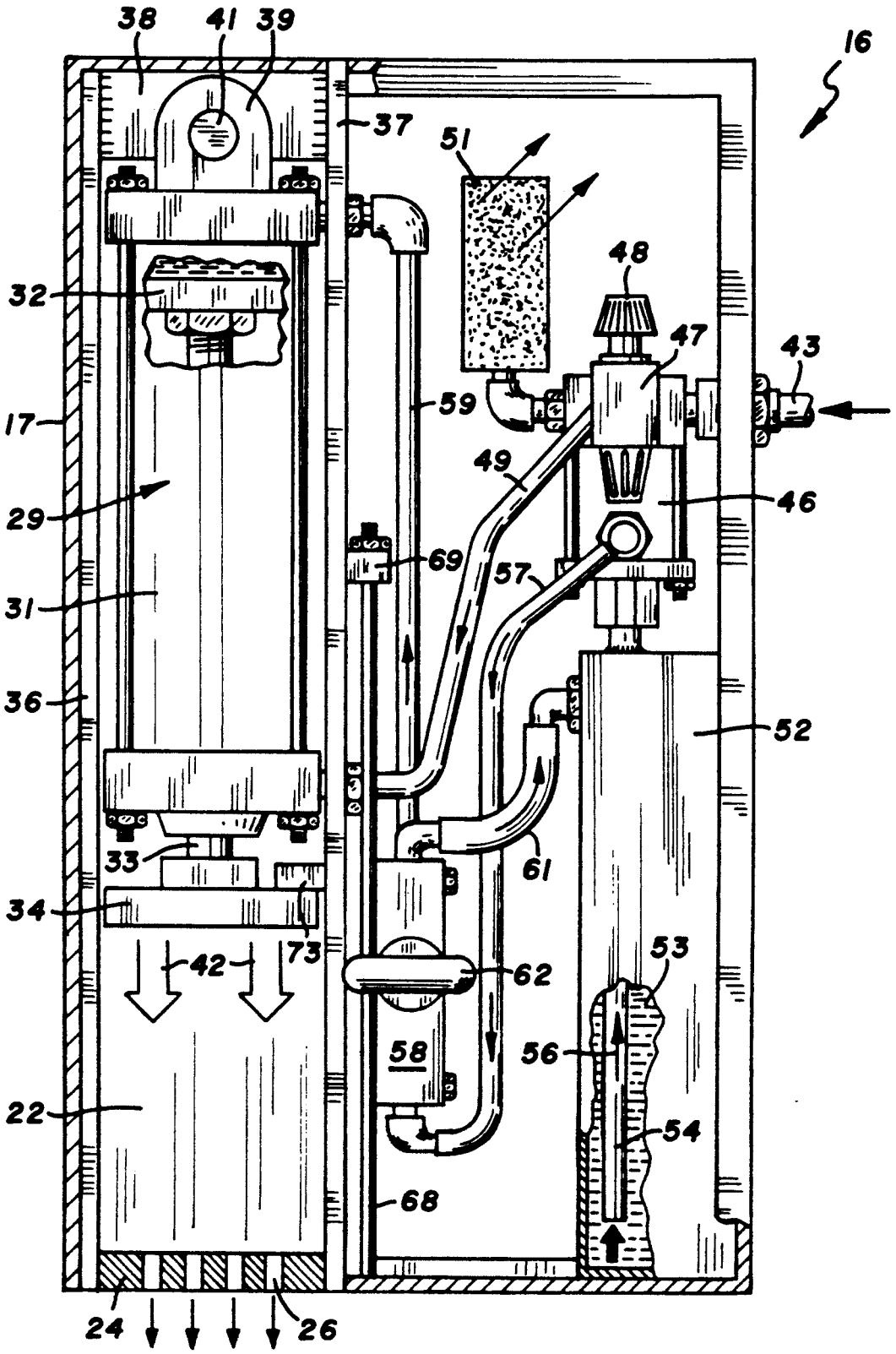
FIG. 4 is an enlarged front elevational view with the front wall removed and partly sectioned of the machine for crushing oil filters of FIG. 1.

Referring to FIG. 4, there is shown crushing apparatus 16 having a piston and cylinder assembly indicated generally at 29 located above crushing chamber 22. Piston and cylinder assembly 29 has an upright cylinder 31 accommodating a piston 32. An elongated downwardly directed piston rod 33 connected to piston 32 extends through the lower end of cylinder 31. A generally horizontal head or crushing member 34 is secured to the lower end of piston rod 33. The piston and cylinder assembly 29 is located between a pair of upright laterally spaced frame plates 36 and 37 that are joined to floor 24 and extend to the top of housing 17. A cross member 38 is secured to the upper ends of plates 36 and 37. Cylinder 31 has a pair of upwardly directed ears 39 located adjacent cross member 38. A pin 41 pivotally connects ears 39 to cross member 38 thereby anchor piston and cylinder assembly 29 on cross member 38. Piston and cylinder assembly 29 operates to move head 34 in a downwardly direction as indicated by arrows 42 to crush oil filter 23 located in crushing chamber 22. When the oil filter is crushed head 34 moves back to the up position as seen in FIG. 4. A linear screw actuator can be used in lieu of piston and cylinder assembly 29 to move head 34 down into crushing chamber 22.

Machine 10 operates with air under pressure from an air pressure source, such as an air compressor. The air is delivered to the machine through an air inlet pipe 43 accommodating an ON/OFF valve 44 as seen in FIG. 1. Returning to FIG. 4, an air driven pump 46 is operated with air under pressure to pump hydraulic fluid, such as oil, under pressure to the upper end of the piston and cylinder assembly 29. An example of the operating pressure of the hydraulic fluid is 1500 psi. Pump 46 is an air driven pump of the type shown by D. C. Hill in U.S. Pat. No. 3,963,383. Other types of pumps can be used to supply hydraulic fluid under pressure to piston and cylinder assembly 29. Pipe 43 is connected to an adjustable air valve 47 having a manually operable knob 48 used to adjust the pressure of the air delivered to a pipe 49 connected to the rod or lower end of the cylinder 31. The air pressure in the rod end of cylinder drives piston 32 to the up position when the pressure of the hydraulic fluid in the head end of cylinder 31 is relieved. Exhaust air from pump 46 flows through a muffler 51.

Pump 46 is mounted on a reservoir or tank 52 located within housing 17. A downwardly directed hose or pipe mounted on top of reservoir 52 extends to the bottom area of reservoir 52 so that oil 53 is drawn from the bottom of resorvoir 52 into pump 46 as indicated by arrow 56. An outlet pipe 57 connects the outlet of pump 46 to a control valve indicated generally at 58. A pipe 59 connects the outlet of control valve 58 to the upper or head end of cylinder 31. A fluid by-pass or return pipe 61 connects valve 58 to the top of reservoir 52 to allow hydraulic fluid to flow from valve 58 back into reservoir 52.

Control valve 58 is a spool valve having a linearly moveable actuator 62 connected to a rod 63. S. E. Keagle in U.S. Pat. No. 3,592,217 shows a spool hydraulic fluid pressure release valve generally similar to valve 58.

Figure 6:
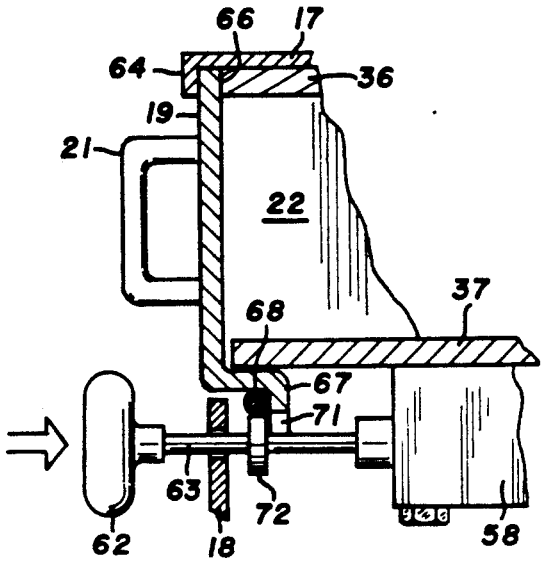
FIG. 6 is a sectional view taken along the line 6—6 of FIG. 5 with the door to the crushing chamber in the closed position.
Figure 7:
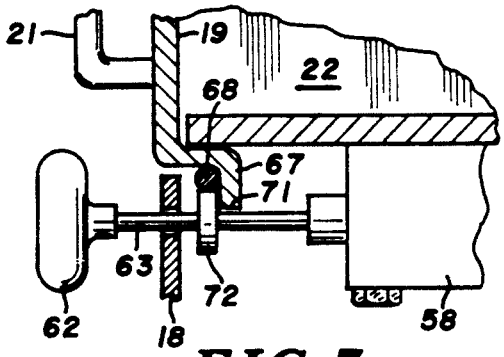
FIG. 7 is a sectional view similar to FIG. 6 showing the door in the open position holding the actuator of the control valve in non-operative position.
Figure 8:
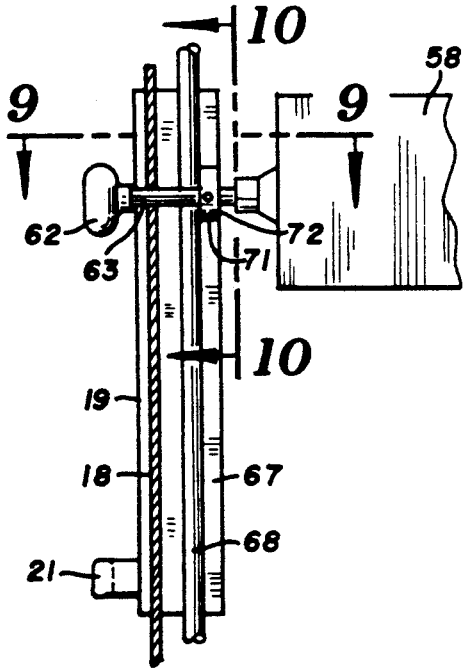
FIG. 8 is a sectional view similar to FIG. 5 showing the door to the crushing chamber in the closed position and the actuator of the control valve in the operative position.
Figure 9:
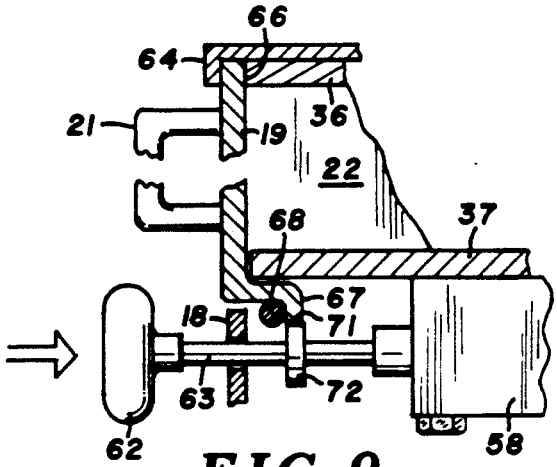
FIG. 9 is a enlarged sectional view taken along the line 9—9 of FIG. 8.

Actuator 62 is moved to an out position, as shown in FIGS. 6 and 7, to block the flow of hydraulic fluid to cylinder 31. Head 34 is in the up position due to the air under pressure in the rod end of cylinder 31. When actuator 62 is moved the in position, as shown in FIGS. 8 and 9, hydraulic fluid pressure is supplied to the head end of cylinder 31 via 59 to force head 34 in a downward direction as indicated by arrows 42 to crush an oil filter located in crushing chamber 22. Actuator 62 can only be moved to the in position when door 19 is closed. In the event that the door 19 is open or partly open, actuator 62 cannot be moved to the in position thereby prevent the flow of hydraulic fluid to the head end of cylinder 31.

Referring to FIG. 6, door 19 is slideably mounted on housing 17 for vertical up and down movements between open and closed positions. Housing 17 has a front lip 64 forwardly of the front edge of plate 36 forming a groove 66 for accommodating an edge of door 19. The opposite edge of door 19 has an offset flange 67 located adjacent the outer surface of plate 37 and about a rod or upright cylindrical guide 68. As seen in FIG. 4, guide 68 is an upright rod secured at the bottom to floor 24. A bracket 69 secures the upper end of rod 68 to plate 37. The inside corner of flange 67 engages rod 68 to guide the door 17 for movement between its open and closed positions.

Returning to FIGS. 6, 8 and 10, the upper end of flange 67 has a concave curved stop edge 71 adapted to engage a stop or disk member 72 secured to the actuator rod 63 to prevent door 19 from being moved from the closed or down position to the up or open position. As seen in FIG. 9, member 72 is in lateral alignment with flange 67 and in engagement with stop edge 71 when actuator 62 is in the in position thereby preventing door 19 from being moved in an upward direction. Valve 58 allows hydraulic fluid to flow under pressure, such as 3,000 psi, to the head end of cylinder 31 to move piston down forcing head 34 down to crush an oil filter in chamber 22.

Figure 5:
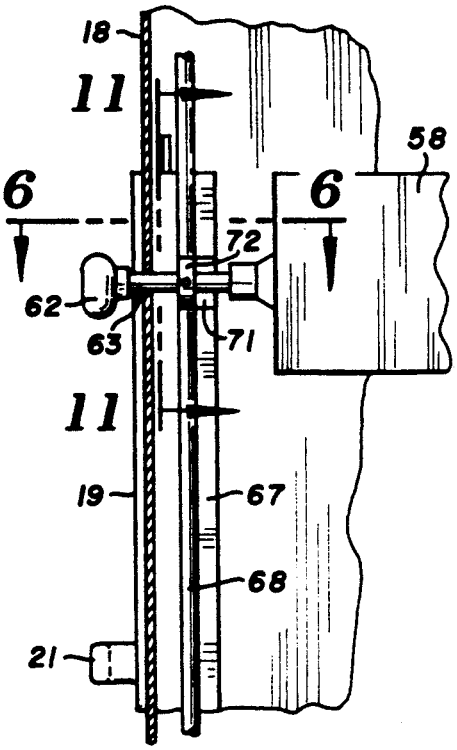
FIG. 5 is an enlarged sectional view taken along the line 5—5 of FIG. 1.

When actuator 62 is moved to the out position, as seen in FIGS. 5 and 6, member 72 is located outwardly of stop edge 71 so that door 19 is free to be moved up to the open position. When actuator 62 is in the out position the hydraulic fluid under pressure is diverted through the by-pass hose or pipe 61 to reservoir 52. Hydraulic fluid under pressure does not flow through pipe 59 to the head end of cylinder 31. Control 58 allows flow of fluid from the head end of cylinder 31 back to reservoir 52 when actuator 62 is in the out position.

Figure 11:
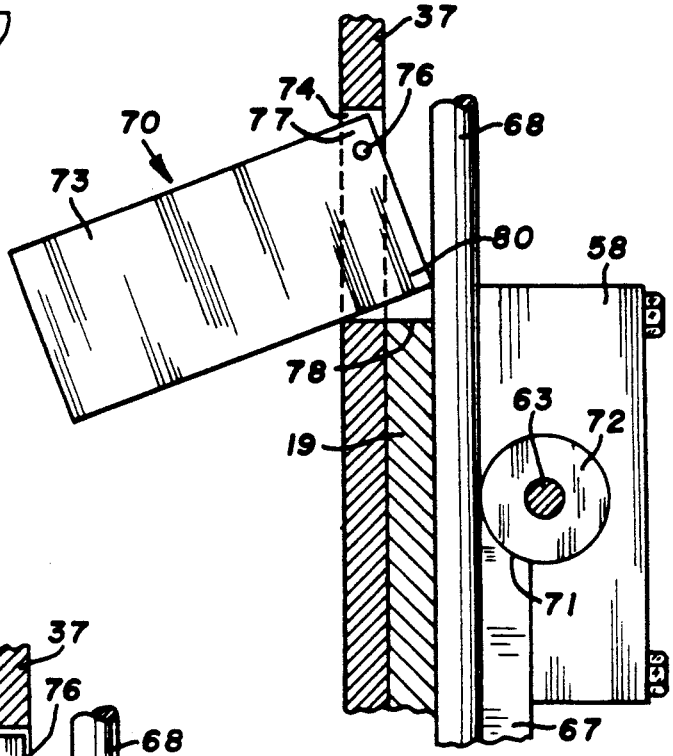
FIG. 11 is an enlarged sectional view taken along the line 11—11 of FIG. 5 showing the door in the closed position and the latch in the door lock position.

Referring to FIG. 11, a second latch mechanism, indicated generally at 70, retains door 19 in the down or closed position when head 34 is in a down position so that door 19 cannot be opened unless head 34 is in the full up inoperative position.

Figure 12:
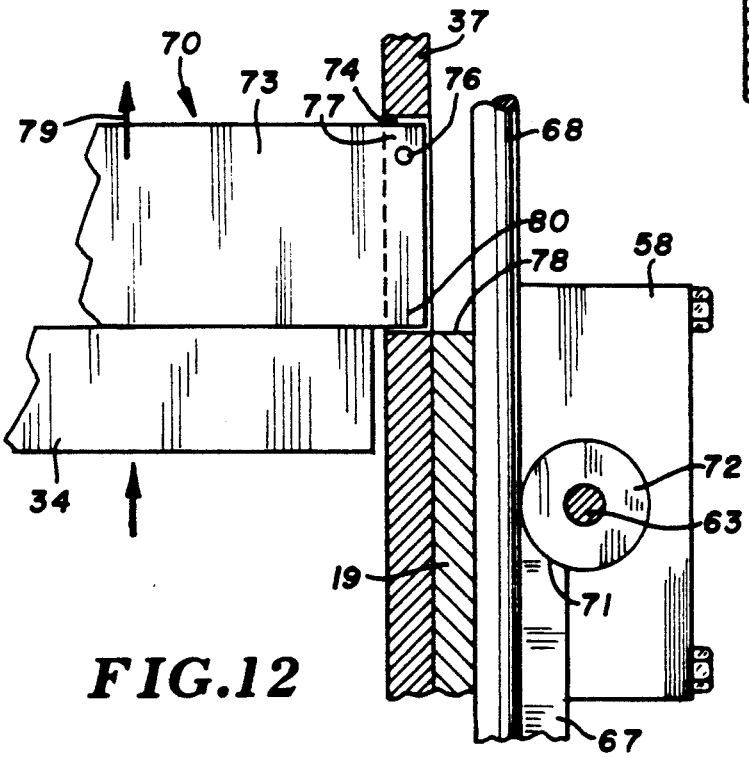
FIG. 12 is a sectional view similar to FIG. 11 showing the latch in the released position.

Second latch mechanism 70 comprises a generally flat lock plate 73 having an end located in a slot 74 in plate 37. Slot 74 has a bottom edge generally aligned with top edge 78 of door 19. A pivot pin 76 pivotally connects an upper corner 77 to plate 37 so that lock plate 73 will normally pivot to a down lock position, as shown in FIG. 11, preventing door 19 from being moved to the open position. Lock plate 73 has a lower corner 80 that projects into the space above door 19 to provide a stop preventing door 19 from being moved up to the open position. As shown in FIG. 12, lock plate 73 has been moved in an upward direction as indicated by arrow 79, by head 34. In other words, when head 34 is raised to its full up position, as seen in FIG. 4, lock plate 73 will be in the release position allowing door 19 to be moved to the open position.

Figure 13:
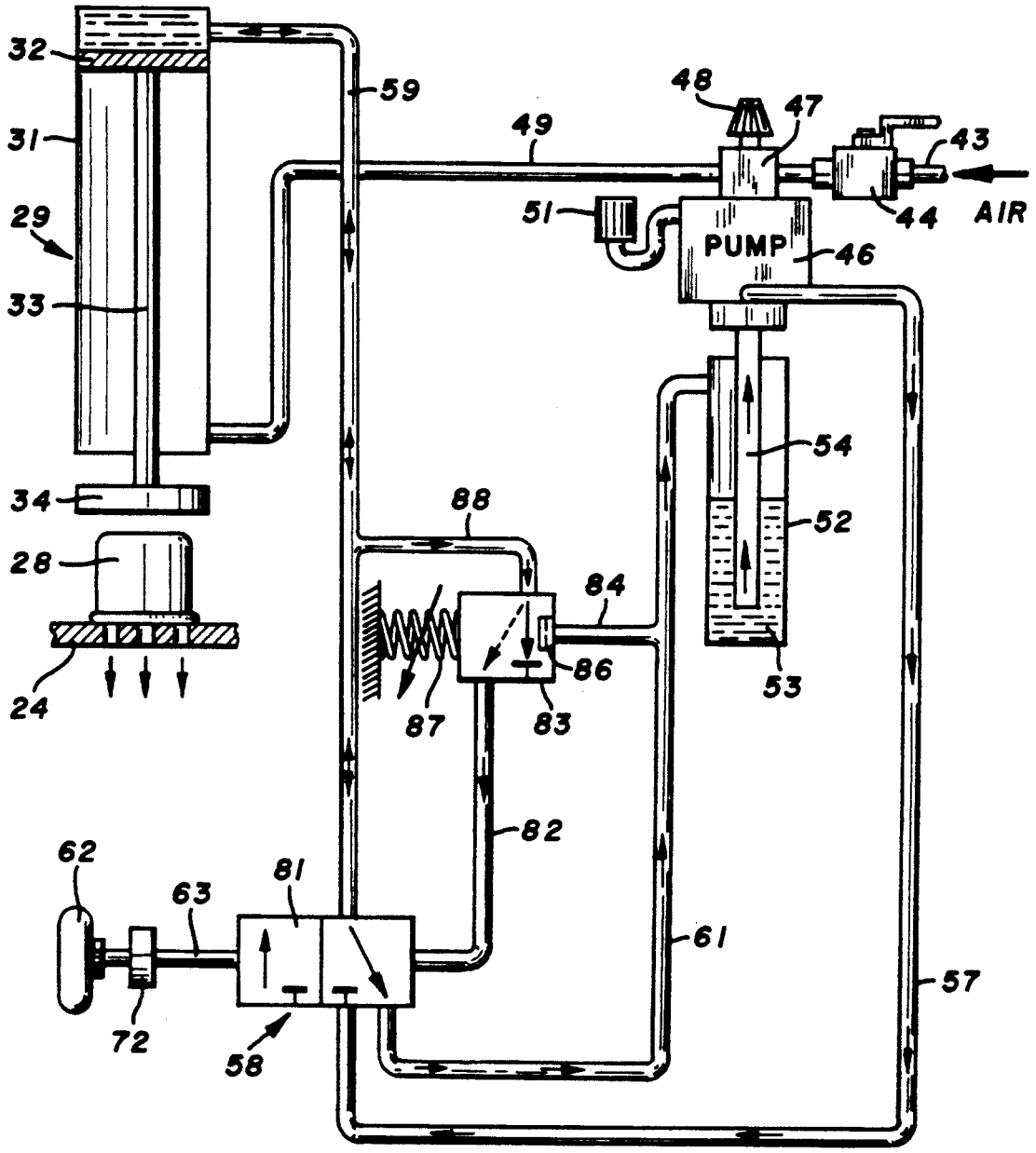
FIG. 13 is a diagramatic view of the air and hydraulic fluid circuits of the machine for crushing oil filters of FIG. 1.

Referring to FIG. 13, there is shown a diagram of the air and hydraulic fluid circuits for machine 10 for crushing oil filters. Control valve 58 has a linearly moveable spool 81 that is moveable from a first OFF position to a second operating position to fluidly connect the fluid pressure pipe 49 to pipe 59 leading to the head end of cylinder 31. Control valve 58 is connected to a fluid line 82 leading to a pressure activated valve 83. The pressure activated valve 83 is responsive to hydraulic fluid under pressure, for example 1500 psi, to move valve 83 from an OFF position to a flow position as shown in broken lines against the force of a spring 87 to deliver hydraulic fluid under pressure to the end of spool 81 which in turn moves control 58 valve to the OFF or fluid return position as shown in FIG. 13. When control valve 58 is in the return position the hydraulic fluid flows from pipe 59 through pipe 61 back to reservoir 52. The hydraulic fluid under pressure from line 57 is blocked. By-pass check valves (not shown) associated with valve 83 delivers excess fluid under pressure back to reservoir 52. A fluid line 84 connects to reservoir return line 61. A fluid flow restrictor 86 is interposed in valve 83 to bleed off hydraulic fluid pressure from line 82 to reservoir return line 61. Restrictor 86 relieves the fluid under pressure that has been supplied to valve 58 so that actuator 62 can be used to move valve 58 in to its ON or in position. The pressure activated valve 83 is connected with fluid line 88 to pressure line 59 leading to the head end of cylinder 31. The hydraulic fluid under pressure in line 88 moves the spool of valve 83 against the pressure of spring 87 to the flow through position when the pressure exceeds the predetermined psi, such as 1500 psi. The spring force of spring 87 can be adjusted so that the operating pressure of valve 83 can be controlled. The pressure activated valve 83 operates in conjunction with control valve 58 to automatically move spool 81 of control valve 58 to the OFF position whereby the fluid under pressure in the head end of cylinder 31 is returned to reservoir 52 via pipes 59 and 61. The air pressure supplied through pipe 49 to the rod end of cylinder 31 forces piston 32 in an upward direction thereby lifting head 34 to the up position.

In operation, head 34 is initially in its up position with actuator 62 for control valve 52 in the out or OFF position. This allows operator to raise door 19 providing access to crushing chamber 22. Oil filter 28 is then placed in crushing chamber 22 with the bottom of the filter resting on floor 24. Door 19 is then moved to the down or shut position, as shown in FIG. 1, to close the front of crushing chamber 22. The entire crushing chamber is enclosed as long as door 19 is closed so that the operator or other persons cannot place any objects, tools or hands in crushing chamber 22.

Figure 10:
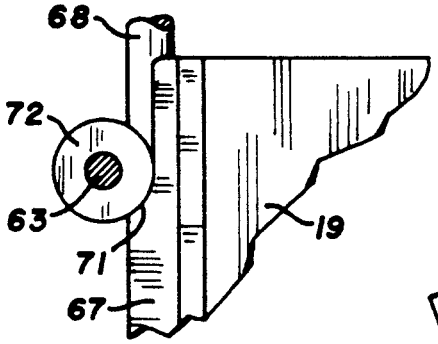
FIG. 10 is a enlarged sectional view taken along the line 10—10 of FIG. 8.

The operator then moves actuator 62 to the in position locating member 72 in the lock position, as shown in FIGS. 8, 9 and 10. Spool 81 of valve 58 is fluidly aligned with pipes 49 and 59 so that on operation of pump 46 with the air under pressure the hydraulic fluid from reservoir 52 will be pumped via pipes 57 and 59 to the head end of cylinder 31. This drives piston 32 in a downward direction forcing head 34 toward the top of oil filter 28. The continued application of hydraulic fluid under pressure to the head end of cylinder 31 forces head 34 downwardly thereby crushing the oil filter 28 and forcing the oil out of the filter. The oil flows through the opening 26 in floor 24 into tank 11. Piston 34 will continue in a downward direction until the resistance to the crushing of the oil filter 28 causes the pressure of the hydraulic fluid in cylinder 31 to increase to a predetermined pressure, such as 1500 psi. When the selected pressure is reached pressure actuator valve 83 operates to move its spool against the force of spring 87 to a flow through position whereby the hydraulic fluid under pressure will move spool 81 of control valve 58 to the OFF position thereby allowing the hydraulic fluid under pressure from the head end of cylinder 31 to flow via pipes 59 and 61 back to the reservoir 52. When the hydraulic fluid under pressure in pipe 59 drops the pressure, responsive valve 83 will move back to its closed position as a result of the biasing force of spring 87. The hydraulic fluid under pressure in fluid line 82 will bleed back through line 84 to the fluid return pipe 61 when the pressure in line 88 is relieved due to movement of control valve 58 to the OFF position. The air under pressure in pipe 49 supplied to the rod end of cylinder 31 will force piston 32 to its up position.

As shown in FIG. 12, when head 34 has reached its up position it will engage lock plate 73 moving it to the unlock position out of engagement with door 19. Door 19 can then be raised to the open position allowing the operator to remove the crushed oil filter and place a new oil filter in crushing chamber 22. Actuator 62, shown in FIG. 7, cannot be moved to the ON position with the door open as member 72 will engage flange 67 preventing actuator 62 from moving spool 81 of control valve 58 to the ON position. As shown in FIGS. 8, 9 and 10, door 19 must be closed before the operator can move actuator 62 to the ON position with member 72 in alignment with stop edge 71 at the top of flange 67 on the side of door 19.

Figure 14:
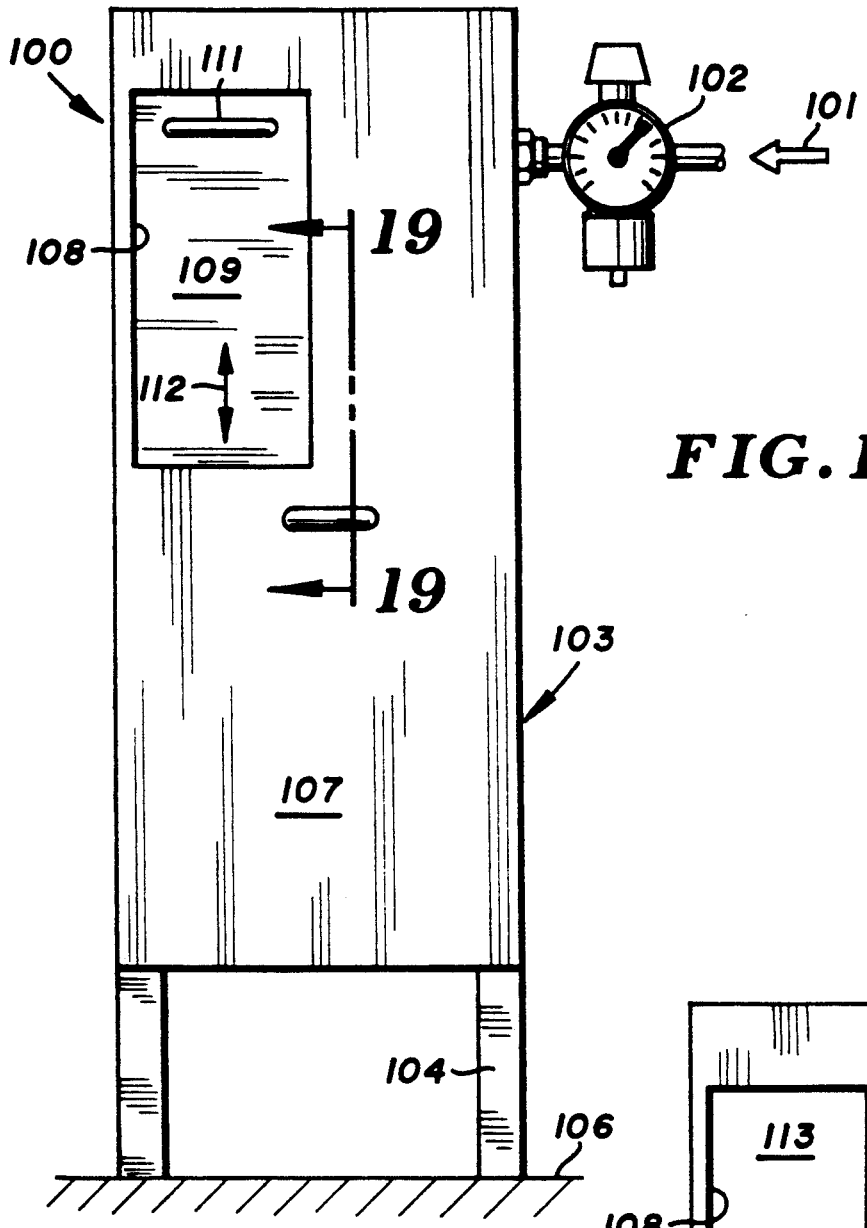
FIG. 14 is a front elevational view of a modification of the machine for crushing oil filters of the invention.
Figure 15:
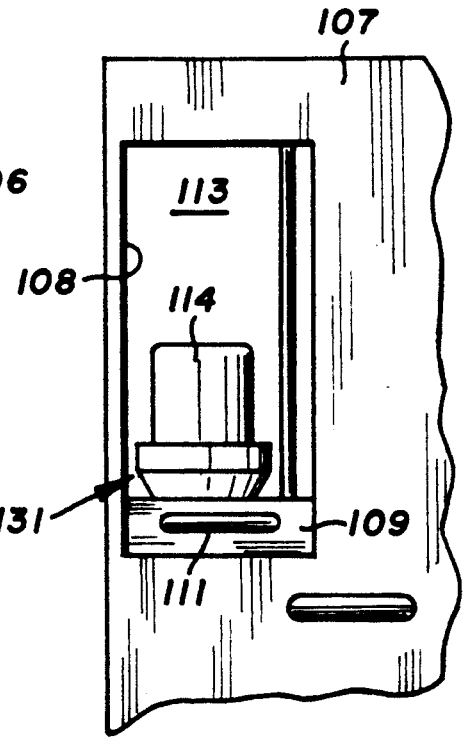
FIG. 15 is a front elevational view of a part of the front of the machine of FIG. 14 with the door in the open position providing access to the crushing chamber.

Referring to FIGS. 14 and 15, there is shown a modification of the machine for crushing oil filters of the invention indicated generally at 100. Machine 100 can be used to crush other articles, such as cans, bottles, containers, boxes made of metal, wood, plastic, paper and the like. Machine 100 described hereinafter is used for crushing oil filters having metal casings used on internal combustion engines.

Machine 100 is operated with air under pressure indicated by arrow 101. The air is delivered to an adjustable valve 102 having a pressure gage mounted on the side of a generally upright housing 103. Housing 103 is supported on a floor or other support surface with a plurality of upright legs 104. Housing 103 has a generally flat upright front wall 107 having an upright rectangular opening 108 in the upper portion thereof. A door 109 is positioned adjacent opening 108 to close the opening into a crushing chamber 113 located within housing 103. Upper portion of door 109 has a generally horizontal handle 111 used by the operator of the machine to move door 109 in up and down directions as indicated by arrow 112 to selectively open and close door 109.

As shown in FIG. 15, door 109 is in the down or open position providing access to oil filter crushing chamber 113. An oil filter 114 is located in crushing chamber 113. The crushing of the oil filter and collection of the oil is hereinafter described. The crushed oil filters and oil can be recycled in an environmentally compatible manner.

Figure 16:
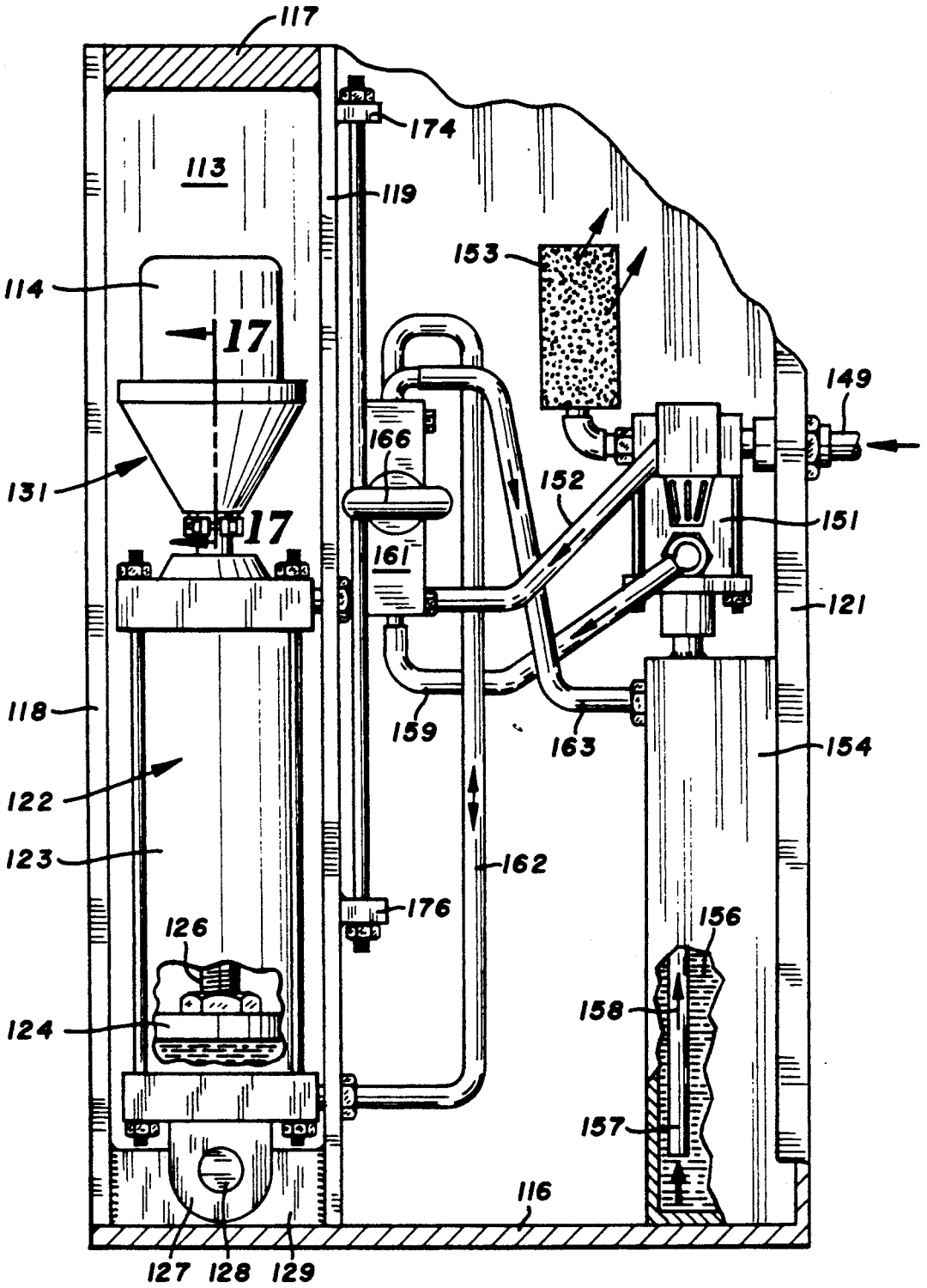
FIG. 16 is an enlarged front elevational view of the machine for crushing oil filters of FIG. 14 with the front wall removed and partly sectioned.

Referring to FIG. 16, machine 100 has a generally horizontal base 116 and a top member 117. A plurality of upright frame members 118 and 119 are joined to base 116 and top member 117 to provide the frame work for machine 100. A case 121 of sheet metal encloses the internal structure of the machine.

A piston and cylinder assembly indicated generally at 122 is located between frame members 118 and 119. Piston and cylinder assembly 122 has a generally upright cylinder 123 slideably accommodating a piston 124. A piston rod 126 secured to piston 124 extends upwardly through the top of cylinder 123 is connected to a platform or crushing member 131 carrying oil filter 114. The bottom of the cylinder has a pair of ears 127 that accommodates a pin 128 connected to plate 129. Piston and cylinder assembly 122 operates to move platform 131 in an upward direction to force the oil filter 114 into crushing engagement with top member 117 in vertical alignment with platform 131. Other types of expandable and contractable structures, such as linear actuators, can be used to crush the oil filters.

Figure 17:
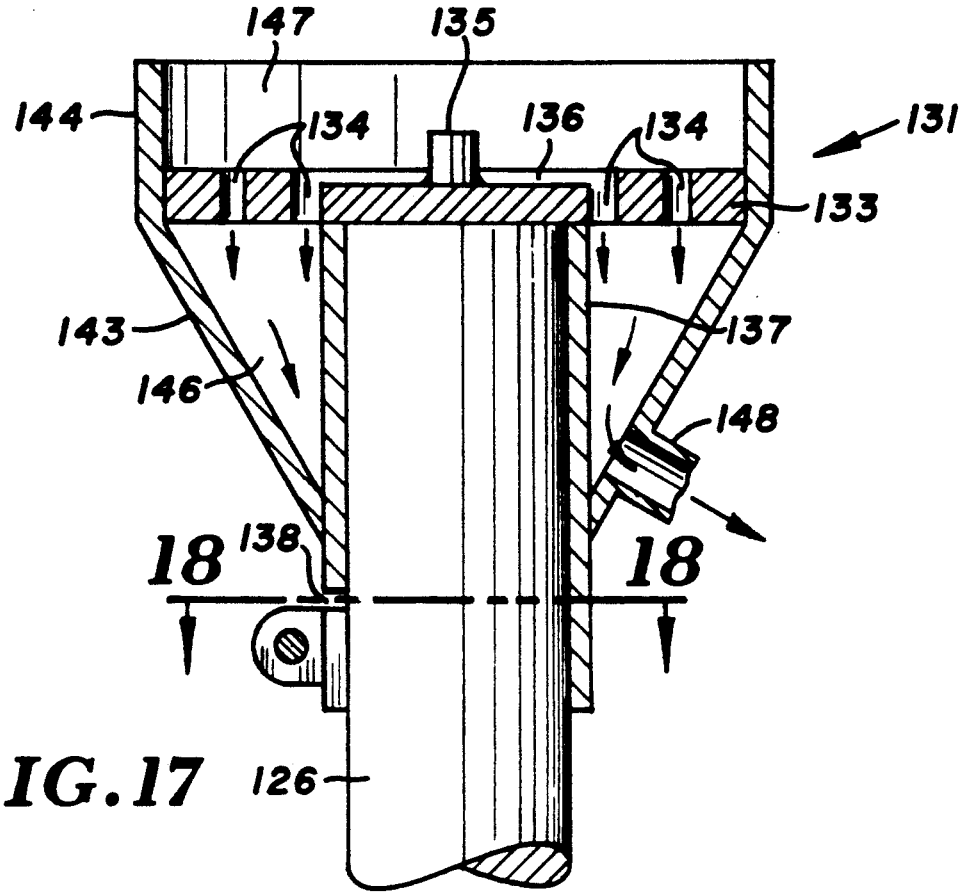
FIG. 17 is an enlarged sectional view taken along the line 17—17 of FIG. 16.
Figure 18:
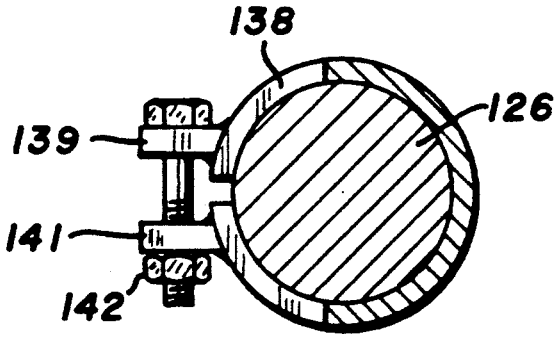
FIG. 18 is a sectional view taken along the line 18—18 of FIG. 17.
Figure 19:
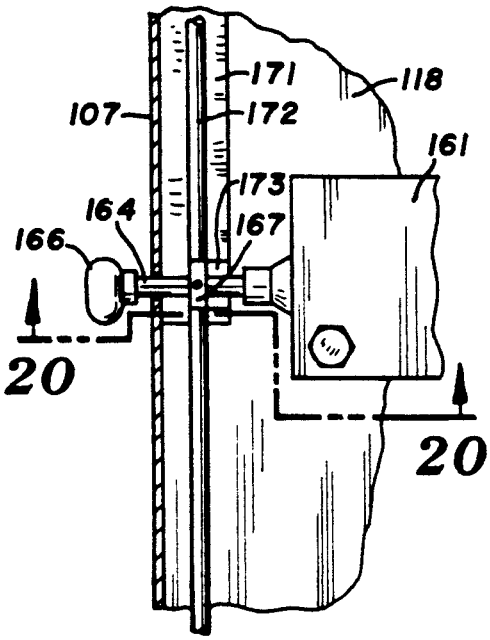
FIG. 19 is an enlarged sectional view taken along the line 19—19 of FIG. 14.

Referring to FIGS. 17 and 18, platform 131 has a square plate 133 having a plurality of holes 134. Plate 133 rests on top of piston rod 126. An upight filter locator pin 135 is secured to the center of plate 133. Radial gooves 136 in the top of plate 133 lead to holes 134 to allow oil to drain from the oil filter. A sleeve 137 surrounds piston rod 126 and extends downwardly from plate 133. The lower portion of sleeve 137 has a circumferential slit 138 having opposite ends secured to ourwardly directed ears 139 and 141. A nut and bolt assembly 142 extended through ears 139 and 141 clamp sleeve 137 onto piston rod 126. Platform 131 has generally upright side walls 143 secured to sleeve 137 and the outer peripheral edge of plate 133 to form an oil collecting chamber 146 below holes 134. Side wall 143 has an upright flange 144 forming a basin 147 with plate 133. The oil is drained from chamber 146 through an outlet drain tube 148 secured to the lower portion of side wall 143. The oil can drain into a container or tank mounted on the back of housing 103. Other oil collection structures can be used to store the oil discharged by the crushing of the oil filters.

Figure 24:
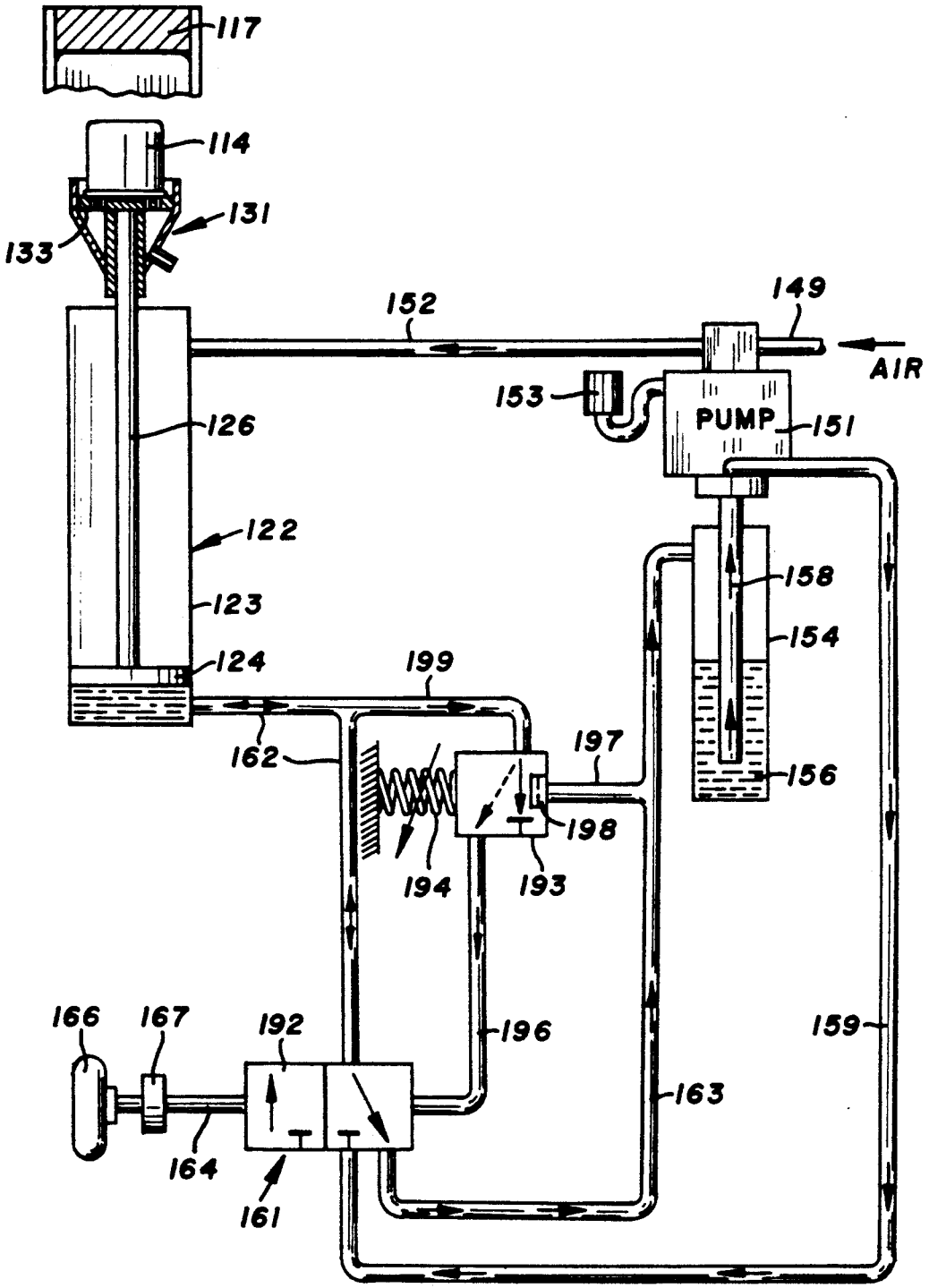
FIG. 24 is a diagramatic view of the air and hydraulic fluid circuits for the machine of FIG. 14.

Machine 100 is operated with air under pressure from the air pressure source, such as an air compressor air line, or the like. As shown in FIGS. 16 and 24, air is delivered to machine 100 through an inlet pipe 149 connected to an air driven pump 151 operable to pump hydraulic fluid, such as oil, to pressures in the range of 1500 psi. Pump 151 is a pump shown by D. C. Hill in U.S. Pat. No. 3,963,383. Other types of pumps can be used to supply hydraulic fluid under pressure to the head end of cylinder 123. An air line 152 carries air under pressure to the rod or upper end of cylinder 123 so that air under pressure biases piston 124 to the down or non-operating position. Air driven pump 151 is connected to a muffler 153 that expells air into the housing. Pump 151 is mounted on a reservoir 154 accommodating oil 156. A pipe 157 extends downwardly into reservoir 154 to carry oil as indicated by arrow 158 to air driven pump 151. The reservoir can be mounted on plate 119 above control valve 161. The oil in the reservoir can flow down through a pipe to the pump mounted on the lower part of plate 119. Pump 151 delivers the oil under pressure through a pipe 159 connected to a control valve indicated generally at 161 mounted on frame member 119 adjacent platform 131. Control valve 161 is also connected to an oil return pipe 163 connected to reservoir 154.

As shown in FIGS. 19 - 22, control valve 161 has a linearly moveable actuator rod 164 connected to a hand grip or knob 166. A stop disc or member 167 is secured to rod 164 inwardly of knob 166. The stop disc 167 cooperates with an edge portion of door 109 to hold door 109 in the closed position when the actuator rod 164 has been moved to the IN or ON position.

Door 109 has an outer edge 168 located in a vertical groove 169 between frame member 118 and front wall 107. The opposite edge of door 109 has an L-shaped upright lip 171 fitted about an upright guide rod 172. The opposite ends of guide rod 172 are secured to blocks 174 and 176 attached to frame member 119, as shown in FIG. 16. Returning to FIG. 20, L-shaped lip 171 also extends adjacent the outside surface of frame member 119 to prevent lateral displacement of door 107 relative to machine 10. Handle 111 is used to manually move door 109 between its open and closed positions.

Figure 20:
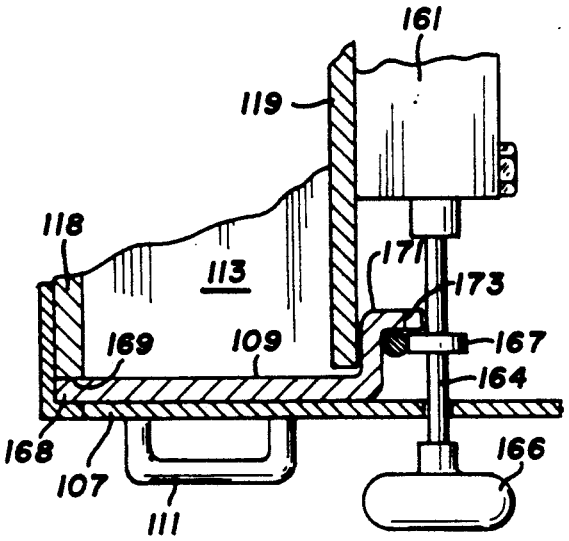
FIG. 20 is an enlarged sectional view taken along the line 20—20 of FIG. 19.
Figure 21:
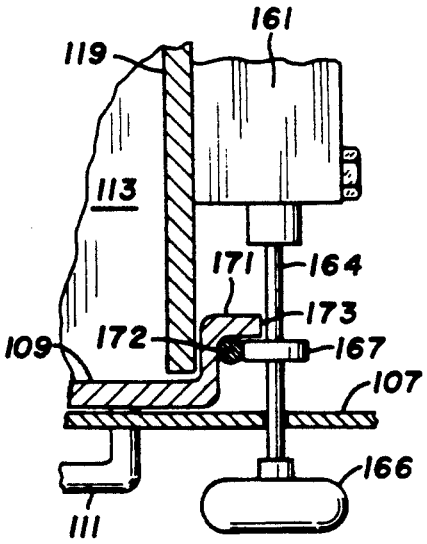
FIG. 21 is a sectional view similar to FIG. 20 showing the actuator in the out/off position.
Figure 22:
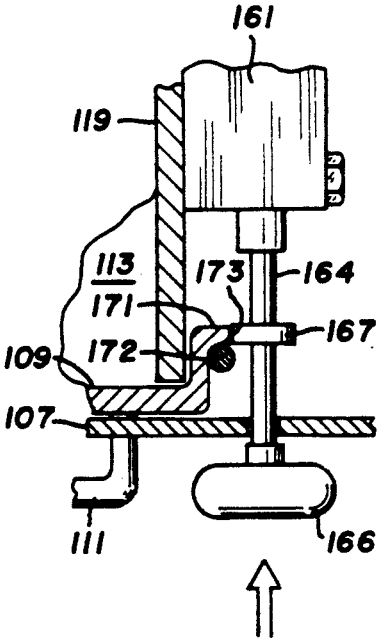
FIG. 22 is a sectional view similar to FIG. 20 showing the actuator in the IN/ON position.

The lower edge of L-shaped lip 171 has a concave shaped cutout or edge portion 173 located adjacent stop disc 167, as shown in FIG. 20. When knob 166 has been moved to the IN position control valve 161 is activated to commence the operation of crushing of an oil filter with the machine. As shown in FIG. 22, disc 167 is located in alignment with the cutout edge portion 173 and functions as a stop to prevent door 109 from being opened. Door 109 will be held in the closed position as long as actuator rod 164 is in the IN position to activate control valve 161.

Figure 23:
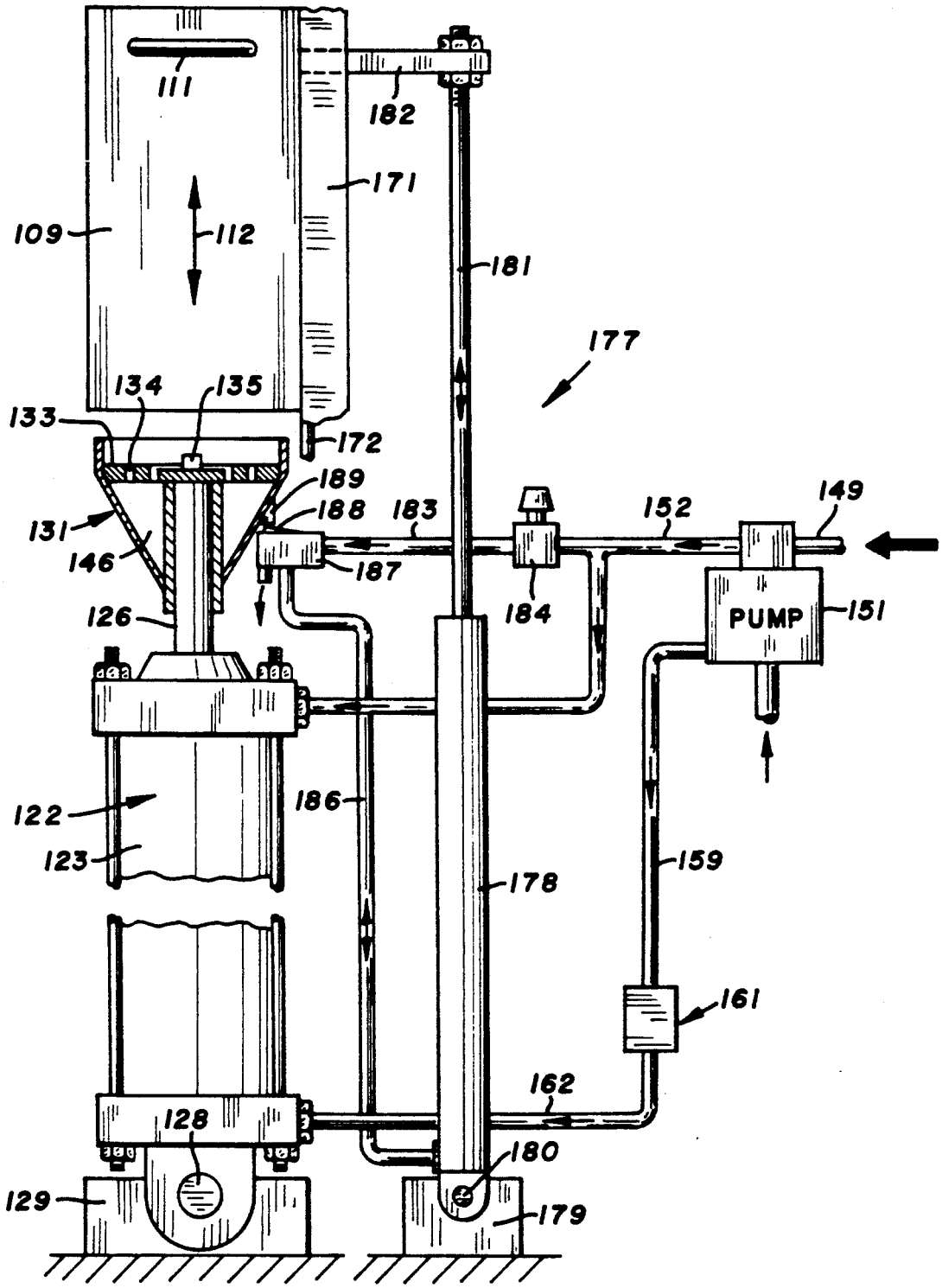
FIG. 23 is a diagramatic view of the air system for holding the door in the closed position.

Referring to FIG. 23, there is shown the second door lock apparatus indicated generally at 177 for holding door 109 in the closed position during the crushing of the oil filter in the crushing chamber and movement of the platform 131 back to its down position. The secon-d lock apparatus 177 has an elongated upright air cylinder 178 attached at its lower end to a mount 179 with a pin 180. An upwardly directed piston rod 181 extends from cylinder 178 to a generally horizontal arm 182 secured to the upper end of door 109. When door 109 is closed and control valve 161 moved to the ON position, air cylinder 161 will be activated to hold 109 closed. Air cylinder 161 will continue to hold door 109 closed until platform 131 has been moved to its down position as herein described. An air line 183 from pump 152 is connected to the lower end of cylinder 178. An adjustable flow regulator 184 interposed in line 183 is used to regulate the air pressure to a three way normally open air valve 187 located below platform 131. A second line 186 connects valve 187 to lower end of air cylinder 178. Valve 187 has an actuator 188 adapted to be engaged with a foot 189 secured to platform 131. Valve 187 is held in the closed position when platform 131 is in the down or non-crushing position as shown in FIG. 23. Line 186 is vented to atmospere through closed valve 187 so that door 109 moves down to its open position. This allows door 109 to slowly move to its open position. When platform 131 moves upwardly away from switch actuator 188, switch 187 will be open thereby allowing air to flow to the lower end of cylinder 187. The air under pressure flowing through line 186 causes the piston 181 to move in an upward direction hereby holding door 109 in the closed position during the crushing of an oil filter in crushing chamber 113 and during movement of platform 131 back to the down position so that the operator or other persons cannot place objects, tools or hands under the platform.

Referring to FIG. 24, there is shown a diagram of the air and hydraulic fluid circuits for machine 100 for crushing oil filters. Control valve 161 has a linearly moveable spool 192 connected to actuator rod 164. Spool 192 is moveable from a first OFF position to a second operating ON position to fluidly connect the fluid pressure pipe 159 to pipe 162 leading to the head end of piston and cylinder assembly 122. Control valve 161 is connected to a fluid line 196 leading to a pressure activated valve 193. Pressure activated valve 193 is responsive to hydraulic fluid under pressure, for example 1500 psi, to move valve 193 from an OFF position to a flow position as shown in broken lines against the force of biasing members 194 such as a spring, to deliver hydraulic fluid under pressure to the end of spool 192 of control valve 161 which in turn moves spool 192 to the OFF or fluid return position. When control valve 161 is in the fluid return position hydraulic fluid flows from pipe 162 through fluid return line 163 back to reservoir 154. The hydraulic fluid under pressure from line 159 is blocked by control valve 161. A fluid line 197 connects valve 193 to reservoir return line 163. A fluid flow restrictor 198 in valve 193 restricts the flow of hydraulic fluid from valve 193 to reservoir return line 163. Restrictor 198 relieves pressure of the fluid that has been supplied to the spool 192 of valve 161 so that actuator rod 164 can be moved to its ON or in position. The pressure activated valve 193 is connected with fluid line 199 to the fluid pressure line 162 leading to the head end of the piston and cylinder assembly 122. The hydraulic fluid under pressure in line 199 moves the spool of valve 193 against the force of spring 194 to the flow through position when pressure exceeds a predetemined psi, such as 1500 psi. The force of spring 194 can be adjusted so that the operating pressure of relief valve 193 can be controled. The pressure activated valve 193 operates in conjuncton with contol valve 161 to automatically move spool 192 of control valve 161 to the OFF position whereby the fluid under pressure in the head end of cylinder assembly 122 is returned to the reservoir via the pipes 162 and 163. The air supplied through pipe 152 to the rod end of piston cylinder assembly 122 forces piston 124 in a downward direction hereby returning platform 133 to its lower position. As sown in FIG. 23, when platform 133 is in the lowered position it will engage actuator 188 of valve 187 thereby supply air under pressure to the lower end of air cylinder 178 thereby relieving the holding force of the air cylinder on door 109. Door 109 moves under air its weight to the lowered or open position. This is a control movement as cylinder 178 functions as a shock absorber preventing door 109 from quickly falling to the open position.

In operation, platform 131 is in the lowered position as shown in FIG. 16. Door 109 is moved to the down or open position as shown in FIG. 15. Oil filter 114 is placed on the center of platform 131 with the oil drain holes of the filter facing plate 133 so that the oil from the oil filter can drain through holes 134 into the chamber 146 during the crushing of the oil filter. The center hole in the bottom of the filter is placed on pin 135 to center the filter on platform 131. The operator then raises door 109 to the up or closed position. Knob 166 attached to actuator rod 164 is moved to the in position thereby locking door 109 in the closed position. Stop disc 167 is aligned with the convex shaped stop wall 173 of lip 171 of door 109 to prevent the door from being moved down as long as the actuator is in its in or on position. When actuator rod 164 is in the in position hydraulic fluid under pressure from pump 151 blows throuh pipe 159, valve 161 and pipe 162 into the lower end of the piston and cylinder assembly 122. This hydraulic fluid under pressure drives piston 124 in an upward direction thereby moving platform 131 and oil filter mounted thereon up into engagement with top member 117. Platform 131 will continue to move in an upward direction thereby crushing oil filter 114 into a flat configuration. The oil squeezed from the oil filter flows through grooves 136 and holes 134 in plate 133 and is collected into a container or tank as it flows out of drain tube 148.

Air cylinder 178 is shown in FIG. 23 is also under air pressure to hold door 109 in the closed position. The door 109 will remain in the closed position until platform 131 has been lowered to close valve 187 and thereby prevent air under pressure from being supplied to cylinder 178. The air in cylinder 178 bleeds off to atmosphere through air control valve 187. This allows door 109 to slowly move to the open position so that the crushed oil filter can be removed from the crushing chamber and replaced with another oil filter. The crushing operation is repeated to crush the next filter.

While there has been shown and described a preferred embodiment of the machine for crushing oil filters, it is understood that other products and objects such as cans, bottles, boxes, containers and the like can be crushed with the machine of the invention. The parts and arrangement of parts may be changed without departing from the invention. The invention is defined in the following claims.

I claim

1. A machine for crushing an oil filter comprising: a tank for collecting oil from an oil filter, an oil filter crushing apparatus mounted on the tank operable to crush an oil filter whereby oil flows from the oil filter into the tank, said crushing apparatus having means movable from a non-crushing position to a crushing position for crushing an oil filter and returning from the crushing position to the non-crushing position, control means for controlling the operation of the means for crushing an oil filter, housing means to enclose said means for crushing an oil filter, said housing means having a door moveable from a closed position to an open position to permit loading and unloading of oil filters into and out of the apparatus, first lock means operatively associated with the control means for holding the door in the closed position during operation of the means for crushing the oil filter, and second lock means movable to a position in engagement with the door to hold the door closed during the operation of the means for crushing an oil filter, said second lock means being independent of the first lock means, said means for crushing an oil filter when in the non-crushing position being engageable with the second lock means to move the second lock means out of engagement with the door whereby the door can only be opened when the means for crushing the oil filter is in the noncrushing position.

2. The machine of claim 1 wherein: the crushing apparatus has frame means providing a crushing chamber for accommodating an oil filter, said means for crushing an oil filter including a piston and cylinder assembly having a cylinder connected to the frame means, a piston moveably located in the cylinder, and a piston rod connected to the piston, a crushing member secured to the piston rod and moveable into the crushing chamber on movement of the piston in the cylinder, and means to supply the cylinder with fluid under pressure to move the piston thereby move the crushing member into the crushing chamber to crush an oil filter located therein.

3. The machine of claim 2 including: control means for regulating the flow of fluid under pressure to the cylinder, said control means having an actuator moveable to a first position to block the flow of fluid to the cylinder and moveable to a second position to allow fluid to flow to the cylinder to move the piston therein, said first lock means having a member mounted on the actuator and engageable with the door to hold the door in the closed position when the actuator is in the second position, said member being out of engagement with the door when the actuator is in the first position thereby allowing the door to be moved from the closed position to the open position.

4. The machine of claim 3 wherein: said door has a side flange with a stop edge engageable with the member to hold the door in the closed position.

5. The machine of claim 2 wherein: the second lock means comprises a latch plate moveably mounted on the frame means for movement between a first position to prevent the door from being moved from the closed position to the open position and for movement with the crushing member to a second position to allow the door to be moved to the open position when the crushing member is above the crushing chamber.

6. The machine of claim 2 including: control means for regulating the flow of fluid under pressure to the cylinder, and pump means operable to supply hydraulic fluid under pressure to the control means, and means for supplying air under pressure to the cylinder opposite the hydraulic fluid whereby the air under pressure moves the crushing member to a non-crushing position in the crushing chamber when the supply of hydraulic fluid to the cylinder has been terminated.

7. The machine of claim 6 wherein: said control means has an actuator moveable to a first position to block the flow of fluid to the cylinder and moveable to a second position to allow fluid to flow to the cylinder, said air under pressure being supplied to said cylinder when the actuator is in both the first and second positions.

8. The machine of claim 7 wherein: said first lock means has a member mounted on the actuator and engageable with the door to hold the door in the closed position when the actuator is in the second position, said member being moved out of engagement with the door when the actuator is in the first position.

9. The machine of claim 1 wherein: the crushing apparatus has frame means providing a crushing chamber for accommodating an oil filter, said means for crushing an oil filter including a piston and cylinder assembly and a crushing member operatively connected to the piston and cylinder assembly moveable into the crushing chamber on operation of the piston and cylinder assembly to crush an oil filter located therein, first means to supply the cylinder with hydraulic fluid under pressure to move the piston and crushing member into the crushing chamber to crush an oil filter located therein, and second means to supply the cylinder with air under pressure to move the piston in an opposite direction thereby moving the crushing member above the crushing chamber.

10. The machine of claim 9 including: pump means operable to supply hydraulic fluid under pressure to the cylinder, control valve means for controlling the supply of hydraulic fluid under pressure to the cylinder,

11. The machine of claim 10 wherein: said control valve has a moveable valving member and an actuator connected to the valving member used to move the valving member between a first position to block the flow of hydraulic fluid to the cylinder and a second position to allow hydraulic fluid to flow to the cylinder to move the piston thereby move, the crushing member relative to the crushing chamber, said first lock means having a stop edge on the door and a member mounted on the actuator engageable with the stop edge of the door to hold the door in the closed position when the actuator is in the second position, said member being out of engagement with the door when the actuator is in the first position.

12. The machine of claim 11 wherein: the second lock means comprises a latch plate moveably mounted on the frame means for movement between a first position to prevent the door from being moved from the closed position to the open position and for movement with the crushing member to a second position to allow the door to be moved to the open position when the crushing member is above the crushing chamber.

13. The machine of claim 1 wherein: the crushing apparatus has frame means providing a crushing chamber for accommodating an oil filter, said means for crushing an oil filter including a piston and cylinder assembly and a crushing member secured to the assembly moveable into the crushing chamber on operation of the assembly, means to supply the piston and cylinder assembly with fluid under pressure to operate the piston and cylinder assembly to move the crushing member into the crushing chamber, and control means including a valve having a moveable valving member and an actuator connected to the valving member used to move the valving member between a first position to block the flow of fluid to the piston and cylinder assembly and a second position to allow fluid to flow to the piston and cylinder assembly to operate the assembly to thereby move the crushing member relative to the crushing chamber to crush an oil filter located therein, said first lock means having a member mounted on the actuator engageable with the door to hold the door in the closed position when the actuator is in the second position, said member being spaced from said door when the actuator is in the first position to allow the door to be moved from the closed position to the open position.

14. The machine of claim 1 wherein: the means for crushing an oil filter includes a piston and cylinder assembly and a crushing member connected to said assembly for crushing an oil filter on operation of the piston and cylinder assembly, pump means for supplying fluid under pressure to the piston and cylinder assembly, a control valve for regulating the flow of fluid to and from the piston and cylinder assembly, said valve having a valving member moveable to a first position to block the flow of fluid to the piston and cylinder assembly and to a second position to allow fluid to flow to the piston and cylinder assembly, and a fluid pressure responsive unit connected to the control valve operable to move the valving member from the first position to the second position in response to a predetermined fluid pressure in the piston and cylinder assembly.

15. An oil filter crushing apparatus operable to crush an oil filter comprising: means for crushing an oil filter, means for moving the means for crushing an oil filter between crushing and non-crushing positions, control means for controlling the operation of the means for crushing an oil filter, housing means to enclose said means for crushing an oil filter, said housing means having a door moveable from a closed position to an open position to permit loading and unloading of oil filters into and out of the apparatus, first lock means operatively associated with the control means for holding the door in the closed position during operation of the means for crushing the oil filter, and second lock means engageable with the door to hold the door in the closed position independent of the first lock means, said mean for crushing an oil filter when in the noncrushing position being engageable with the second lock means to disengage the second lock means from the door whereby the door can be moved to the open position.

16. The apparatus of claim 15 wherein: the crushing apparatus has frame means providing a crushing chamber for accommodating an oil filter, said means for crushing an oil filter including a piston and cylinder assembly having a cylinder connected to the frame means, a piston moveably located in the cylinder, and a piston rod connected to the piston, a crushing member secured to the piston rod and moveable into the crushing chamber on movement of the piston in the cylinder, and means to supply the cylinder with fluid under pressure to move the piston to thereby move the crushing member into the crushing chamber to crush an oil filter located therein.

17. The apparatus of claim 16 wherein: the crushing member comprises a platform having at least one hole mounted on the piston rod for supporting an oil filter, and wall means connected to the platform having a chamber to collect oil from the oil filter.

18. The apparatus of claim 16 including: control means for regulating the flow of fluid under pressure to the cylinder, said control means having an actuator moveable to a first position to block the flow of fluid to the cylinder and moveable to a second position to allow fluid to flow to the cylinder to move the piston therein, said first lock means having a member mounted on the actuator and engageable with the door to hold the door in the closed position when the actuator is in the second position, said member being out of engagement with the door when the actuator is in the first position thereby allowing the door to be moved from the closed position to the open position.

19. The apparatus of claim 18 wherein: said door has a side flange with a stop edge engageable with the member to hold the door in the closed position.

20. The apparatus of claim 16 including: a latch plate moveably mounted on the frame means for movement between a first position to prevent the door from being moved from the closed position to the open position and for movement with the crushing member to a second position to allow the door to be moved to the open position when the crushing member is above the crushing chamber.

21. The apparatus of claim 16 wherein: the second lock means comprises holding means connected to the door for holding the door in the closed position during the crushing of the oil filter, and control means activated in response to movement of the crushing member to actuate the holding means during the crushing of the oil filter and deactivate the holding means when the crushing member is in a non-crushing position.

22. The apparatus of claim 21 wherein: the holding means is an air actuated piston and cylinder assembly connected to the door to hold the door closed during crushing of the oil filter, said control means comprising an air control valve connected to a supply of air under pressure and the piston and cylinder assembly, said air control valve having an actuator movable to a first position to allow air under pressure to flow to the piston and cylinder assembly whereby the piston and cylinder assembly holds the door closed and movable to a second position by the crushing member to allow air under pressure to flow out of the piston and cylinder assembly whereby the door moves from the closed position to the open position.

23. The apparatus of claim 16 including: control means for regulating the flow of fluid under pressure to the cylinder, and pump means operable to supply hydraulic fluid under pressure to the control means, and means for supplying air under pressure to the cylinder opposite the hydraulic fluid whereby the air under pressure moves the crushing member to a non-crushing position in the crushing chamber when the supply of hydraulic fluid to the cylinder has been terminated.

24. The apparatus of claim 23 wherein: said control means has an actuator moveable to a first position to block the flow of fluid to the cylinder and moveable to a second position to allow fluid to flow to the cylinder, said air under pressure being supplied to said cylinder when the actuator is in both the first and second positions.

25. The apparatus of claim 24 wherein: said first lock means has a member mounted on the actuator and engageable with the door to hold the door in the closed position when the actuator is in the second position, said member being moved out of engagement with the door when the actuator is in the first position.

26. The apparatus of claim 15 wherein: the crushing apparatus has frame means providing a crushing chamber for accommodating an oil filter, said means for crushing an oil filter including a piston and cylinder assembly and a crushing member operatively connected to the piston and cylinder assembly moveable into the crushing chamber on operation of the piston and cylinder assembly to crush an oil filter located therein, first means to supply the cylinder with hydraulic fluid under pressure to move the piston and crushing member into the crushing chamber to crush an oil filter located therein, and second means to supply the cylinder with air under pressure to move the piston in an opposite direction thereby moving the crushing member above the crushing chamber.

27. The apparatus of claim 26 including: pump means operable to supply hydraulic fluid under pressure to the cylinder, control valve means for controlling the supply of hydraulic fluid under pressure to the cylinder,

28. The apparatus of claim 27 wherein: said control valve has a moveable valving member and an actuator connected to the valving member used to move the valving member between a first position to block the flow of hydraulic fluid to the cylinder and a second position to allow hydraulic fluid to flow to the cylinder to move the piston to thereby move the crushing member relative to the crushing chamber, said first lock means having a stop edge on the door and a member mounted on the actuator engageable with the stop edge of the door to hold the door in the closed position when the actuator is in the second position, said member being out of engagement with the door when the actuator is in the first position.

29. The apparatus of claim 28 wherein: the second lock means comprises a latch plate moveably mounted on the frame means for movement between a first position to prevent the door from being moved from the closed position to the open position and for movement with the crushing member to a second position to allow the door to be moved to the open position when the crushing member is above the crushing chamber.

30. The apparatus of claim 28 including: cylinder means connected to the door for holding the door in the closed position during the crushing of the oil filter, and control means activated in response to movement of the crushing member to actuate the cylinder means during the crushing of the oil filter and deactivate the cylinder means when the crushing member is in a non-crushing position.

31. The apparatus of claim 15 wherein: the crushing apparatus has frame means providing a crushing chamber for accommodating an oil filter, said means for crushing an oil filter including a piston and cylinder assembly and a crushing member secured to the assembly moveable into the crushing chamber on operation of the assembly, means to supply the piston and cylinder assembly with fluid under pressure to operate the piston and cylinder assembly to move the crushing member into the crushing chamber, and control means including a valve having a moveable valving member and an actuator connected to the valving member used to move the valving member between a first position to block the flow of fluid to the piston and cylinder assembly and a second position to allow fluid to flow to the piston and cylinder assembly to operate the assembly to thereby move the crushing member relative to the crushing chamber to crush an oil filter located therein, said first lock means having a member mounted on the actuator engageable with the door to hold the door in the closed position when the actuator is in the second position, said member being spaced from said door when the actuator is in the first position to allow the door to be moved from the closed position to the open position.

32. The apparatus of claim 15 wherein: the means for crushing an oil filter includes a piston and cylinder assembly and a crushing member connected to said assembly for crushing an oil filter on operation of the piston and cylinder assembly, pump means for supplying fluid under pressure to the piston and cylinder assembly, a control valve for regulating the flow of fluid to and from the piston and cylinder assembly, said valve having a valving member moveable to a first position to block the flow of fluid to the piston and cylinder assembly and to a second position to allow fluid to flow to the piston and cylinder assembly, and a fluid pressure responsive unit connected to the control valve operable to move the valving member from the first position to the second position in response to a predetermined fluid pressure in the piston and cylinder assembly.

33. An apparatus for crushing an object comprising: means for crushing an object, power means for moving the means for crushing an object between crushing and non-crushing positions, control means for controlling the operation of the power means, housing means to enclose said means for crushing an object, said housing means having a door moveable from a closed position to an open position to permit loading and unloading of the object into and out of the apparatus, first lock means operatively associated with the control means for holding the door in the closed position during the operation of the power means, and second lock means engageable with the door to hold the door in the closed position independent of the first lock means, said means for crushing an object when in the non-crushing position being operatively associated with the second lock means to disengage the second lock means from the door whereby the door can be moved to the open position.

34. The apparatus of claim 33 including: frame means providing a crushing chamber for accommodating an object, said means for crushing an object including a piston and cylinder assembly having a cylinder connected to the frame means, a piston moveably located in the cylinder, and a piston rod connected to the piston, a crushing member secured to the piston rod and moveable into the crushing chamber on movement of the piston in the cylinder, and means to supply, the cylinder with fluid under pressure to move the piston to thereby move the crushing member into the crushing chamber to crush an object located therein.

35. The apparatus of claim 34 including: control means for regulating the flow of fluid under pressure to the cylinder, said control means having an actuator moveable to a first position to block the flow of fluid to the cylinder and moveable to a second position to allow fluid to flow to the cylinder to move the piston therein, said first lock means having a member mounted on the actuator and engageable with the door to hold the door in the closed position when the actuator is in the second position, said member being out of engagement with the door when the actuator is in the first position thereby allowing the door to be moved from the closed position to the open position.

36. The apparatus of claim 35 wherein: said door has a side flange with a stop edge engageable with the member to hold the door in the closed position.

37. The apparatus of claim 35 wherein: the second lock means comprises a latch plate moveably mounted on the frame means for movement between a first position to prevent the door from being moved from the closed position to the open position and for movement with the crushing member to a second position to allow the door to be moved to the open position when the crushing member is above the crushing chamber.

38. The apparatus of claim 35 wherein: the second lock means comprises holding means connected to the door for holding the door in the closed position during the crushing of the object and control means activated in response to movement of the crushing member to activate the holding means during the crushing of the object and deactivate the holding means when the crushing member is in a non-crushing position.

39. The apparatus of claim 38 wherein: the holding means is an air actuated piston and cylinder assembly connected to the door to hold the door closed during crushing of the object said control means comprising an air control valve connected to a supply of air under pressure and the piston and cylinder assembly, said air control valve having an actuator movable to a first position to allow air under pressure to flow to the piston and cylinder assembly whereby the piston and cylinder assembly holds the door closed and movable to a second position by the crushing member to allow air under pressure to flow out of the piston and cylinder assembly whereby the door moves from the closed position to the open position.

40. The apparatus of claim 35 including: control means for regulating the flow of fluid under pressure to the cylinder, and pump means operable to supply hydraulic fluid under pressure to the control means, and means for supplying air under pressure to the cylinder opposite the hydraulic fluid whereby the air under pressure moves the crushing member above the crushing chamber when the supply of hydraulic fluid to the cylinder has been terminated.

41. The apparatus of claim 40 wherein: said control means has an actuator moveable to a first position to block the flow of fluid to the cylinder and moveable to a second position to allow fluid to flow to the cylinder, said air under pressure being supplied to said cylinder when the actuator is in both the first and second positions.

42. The apparatus of claim 41 wherein: said first lock means has a member mounted on the actuator and engageable with the door to hold the door in the closed position when the actuator is in the second position, said member being moved out of engagement with the door when the actuator is in the first position.

43. The apparatus of claim 33 wherein: the crushing apparatus has frame means providing a crushing chamber for accommodating an object, said means for crushing an object including a piston and cylinder assembly and a crushing member operatively connected to the piston and cylinder assembly moveable into the crushing chamber on operation of the piston and cylinder assembly to crush an object located therein, first means to supply the cylinder with hydraulic fluid under pressure to move the piston and crushing member into the crushing chamber to crush an object located therein, and second means to supply the cylinder with air under pressure to move the piston in an opposite direction thereby moving the crushing member above the crushing chamber.

44. The apparatus of claim 43 including: pump means operable to supply hydraulic fluid under pressure to the cylinder, control valve means for controlling the supply of hydraulic fluid under pressure to the cylinder,

45. The apparatus of claim 44 wherein: said control valve has a moveable valving member and an actuator connected to the valving member used to move the valving member between a first position to block the flow of hydraulic fluid to the cylinder and a second position to allow hydraulic fluid to flow to the cylinder to move the piston to thereby move the crushing member relative to the crushing chamber, said first lock means having a stop edge on the door and a member mounted on the actuator engageable with the stop edge of the door to hold the door in the closed position when the actuator is in the second position, said member being out of engagement with the door when the actuator is in the first position.

46. The apparatus of claim 45 wherein: the second lock means comprises a latch plate moveably mounted on the frame means for movement between a first position to prevent the door from being moved from the closed position to the open position and for movement with the crushing member to a second position to allow the door to be moved to the open position when the crushing member is above the crushing chamber.

47. The apparatus of claim 45 including: cylinder means connected to the door for holding the door in the closed position during the crushing of the oil filter, and control means activated in response to movement of the crushing member to activate the cylinder means during the crushing of the object and deactivate the cylinder means when the crushing member is in a non-crushing position.

48. The apparatus of claim 33 including: frame means providing a crushing chamber for accommodating an oil filter, said means for crushing an oil filter including a piston and cylinder assembly and a crushing member secured to the assembly moveable into the crushing chamber on operation of the assembly, means to supply the piston and cylinder assembly with fluid under pressure to operate the piston and cylinder assembly to move the crushing member into the crushing- chamber, and control means including a valve having a moveable valving member and an actuator connected to the valving member used to move the valving member between a first position to block the flow of fluid to the piston and cylinder assembly and a second position to allow fluid to flow to the piston and cylinder assembly to operate the assembly to thereby move the crushing member relative to the crushing chamber to crush an oil filter located therein, said first lock means having a member mounted on the actuator engageable with the door to hold the door in the closed position when the actuator is in the second position, said member being spaced from said door when the actuator is in the first position to allow the door to be moved from the closed position to the open position.

49. The apparatus of claim 33 wherein: the object is an oil filter, the means for crushing the object includes a piston and cylinder assembly and a crushing member connected to said assembly for crushing the oil filter an operation of the piston and cylinder assembly, pump means for supplying fluid under pressure to the piston and cylinder assembly, a control valve for regulating the flow of fluid to and from the piston and cylinder assembly, said valve having a valving member moveable to a first position to block the flow of fluid to the piston and cylinder assembly and to a second position to allow fluid to flow to the piston and cylinder assembly, and a fluid pressure responsive unit connected to the control valve operable to move the valving member from the first position to the second position in response to a predetermined fluid pressure in the piston and cylinder assembly.

50. An apparatus for crushing an object comprising: a piston and cylinder assembly, a crushing member operatively connected to the piston and cylinder assembly and moveable thereby to crush an object, pump means operable to supply hydraulic fluid under pressure to the piston and cylinder assembly to move the crushing member in a direction to crush an object, means for supplying air under pressure to the cylinder assembly opposite the hydraulic fluid whereby the air under pressure moves the crushing member back to its first position when the supply of hydraulic fluid to the cylinder has been terminated, control means for controlling the operation of the means for crushing an object, housing means to enclose said means for crushing an object, said housing means having a door moveable from a closed position to an open position to permit loading and unloading of an object into and out of the apparatus, first lock means operatively associated with the control means for holding the door in the closed position during the operation of the means for crushing and object, and second lock means for holding the door in the closed position when the crushing member is in all positions except the non-crushing position, said second lock means comprising a latch plate mounted for movement between a first position to prevent the door from being moved from the closed position to the open position and for movement with the crushing member to a second position to allow the door to be moved to the open position when the crushing member is in the non-crushing position.

51. The apparatus of claim 50 including: a control valve for controlling the flow of hydraulic fluid from the pump means to the cylinder, said control valve having a valving member moveable from a first position to block the flow of hydraulic fluid to the cylinder and a second position to allow hydraulic fluid to flow to the cylinder, and pressure responsive means operatively connected to the valving member to move the valving member from the second position to the first position when the pressure of the hydraulic fluid supplied to the cylinder attains a predetermined pressure whereby the flow of hydraulic fluid to the cylinder is terminated and said air under pressure moves the crushing member back to its first position.

52. The apparatus of claim 50 wherein: the second lock means comprises holding means connected to the door for holding the door in the closed position during the crushing of the oil filter, and control means activated in response to movement of the crushing member to activate the holding means during the crushing of the object and deactivate the holding means when the crushing member is in a non-crushing position.

53. The apparatus of claim 52 wherein: the holding means is an air actuated piston and cylinder assembly connected to the door to hold the door closed during crushing of the object said control means comprising an air control valve connected to a supply of air under pressure and the piston and cylinder assembly, said air control valve having an actuator movable to a first position to allow air under pressure to flow to the piston and cylinder assembly whereby the piston and cylinder assembly holds the door closed and movable to a second position by the crushing member to allow air under pressure to flow out of the piston and cylinder assembly whereby the door moves from the closed position to the open position.

54. An oil filter crushing apparatus operable to crush an oil filter comprising: a frame having a base for supporting an oil filter, first means for crushing an oil filter located on the base, means for moving the first means between crushing and non-crushing positions, second means movable from a closed position to an open position relative to the base to allow an oil filter to be placed on the base and removed from the base, and third means for preventing operation of the first means for crushing the oil filter when the first lock means for holding the second means in the closed second means is in the open position, said third means includes a position during operation of the first means to crush an oil filter, and a second lock means engageable with the second means to hold the second means in the closed position independent of the first lock means, said second lock means being disengaged from the second means by the first means when the non-crushing position.

55. The apparatus of claim 54 wherein: the first means includes a piston and cylinder assembly operable to crush an oil filter located on the base.

56. The apparatus of claim 54 wherein: the second means includes a member movable from a down closed position to an up open position to allow an oil filter to be placed on the base and removed from the base.

57. The apparatus of claim 54 wherein: the second means includes a member movable from an up closed position to a down open position to allow an oil filter to be placed on the base and removed from the base.

58. The apparatus of claim 54 wherein: the first means includes a piston and cylinder assembly operable to crush an oil filter located on the base, the second means includes a member movable from a down closed position to an up open position to allow an oil filter to be placed on the base and removed from the base.

* * * * *